United States Patent [19]

Krieps

[11] Patent Number: 4,747,736

[45] Date of Patent: May 31, 1988

[54] DECK HANGER FOR AN INTERMODAL CONTAINER

[75] Inventor: George D. Krieps, Wauconda, Ill.

[73] Assignee: White Welding and Mfg., Inc., Kenosha, Wis.

[21] Appl. No.: 944,041

[22] Filed: Dec. 22, 1986

[51] Int. Cl.[4] ..... B63B 25/24

[52] U.S. Cl. ..... 410/54; 410/4; 24/134 R

[58] Field of Search ..... 410/4, 52, 540, 17, 410/26, 130, 150, 129, 143; 105/370; 248/235–237, 217.1; 24/134 R, 134 N, 134 L, 132 WC

[56] References Cited

U.S. PATENT DOCUMENTS

| | | | |
|---|---|---|---|
| 389,224 | 9/1888 | Himmele | 248/236 |
| 1,469,967 | 10/1923 | Sedviek | 248/231.5 |
| 2,155,888 | 4/1939 | Boomgarden | 248/237 |
| 2,866,248 | 12/1958 | Reno | 410/106 |
| 4,019,705 | 4/1977 | Habuda, Sr. | 248/58 |
| 4,637,763 | 1/1987 | Van Iperen | 410/52 |

*Primary Examiner*—Robert R. Song

[57] ABSTRACT

A hanger which supports a temporary deck in an intermodal container. The hanger is removably secured to a ledge, which is part of the container, and extends downwardly toward the floor. One set of hangers is placed along each wall and the temporary deck is extended between them. The hanger itself includes a hook end and a link pivotally secured to a lower position. The link pivotally carries the hanger strap that extends down the wall. The hook end fits over the top of the ledge while the link contacts it on the bottom in a pliers-like grip. As vertical force is placed upon the hanger strap, the grip of the hook end and link increases.

10 Claims, 2 Drawing Sheets

DECK HANGER FOR AN INTERMODAL CONTAINER

BACKGROUND OF THE INVENTION

The field of this invention relates to the provision of at least one temporary deck in the open cargo space of an intermodal container. More specifically, it relates to the hanger means which extend downwardly from the ceiling to the floor of the container and from which the deck is supported.

As is known in the freight industry, that particular goods or products, for whatever purpose, can bear only so much weight in transport. For example, there are limitations on the amount of weight that the average shipping container of electronic products can bear. Additionally, certain products, such as automobiles, by virtue of the fact of their size and design and the fact they are not shipped in containers, are not stackable directly one on another. At the same time the trend in the industry is that the size of intermodal cargo containers are growing larger and larger. Additionally, the increase in size of semi-truck trailers is following a change in the legal maximum cargo weight. Thus, the cargo space available and weight limitations have increased faster than the load-carrying capacity of the packaging boxes of the products being shipped. As a result, it may be possible to only fill one-half or even one-third of an intermodal container without running the risk of crushing or in some way damaging the product on the bottom of the stack.

In order to solve this stacking problem, it is a known industry practice to divide up the open cargo area of an intermodal container with various decks. Thus, all of the available cargo space can be effectively used without the risk of crushing any of the product.

For the most part such systems incorporate temporary decking devices with which few problems have been encountered. However, in the area of the hanger means, which support the decking devices, certain difficulties have been experienced. As is apparent, these systems are by their very nature temporary and thus the hanger means must be installed quickly and efficiently with little or no modification to the existing intermodal container.

Because the top rail is a common element on various types of intermodal cargo containers, deck hangers have in some way made use of them in the support of the deck. In the normal situation, the top rail is an integral part of the cargo container and generally extends the length of the container on both sides thereof a few inches from the top. It can take various shapes as well as have different attachment to the container itself, but a common feature is a ledge or projection which extends out into the cargo area several inches. The deck hanger thus incorporates some means for cooperating with the top rail while the portion that extends down the side wall of the cargo container includes other means that facilitate the carrying of the deck. In practice, such deck hangers will be positioned every one foot or so depending on the load to be carried, the length of both major walls of the cargo container. Cross members are then extended from one wall to the other and the flooring placed thereon.

As stated, however, this is not without difficulty. For example, whatever the gripping means which is provided to cooperate with the top rail, it must take into consideration manufacturing variances with respect to the thickness of the top rail and with respect to tolerance stack-up of the hanger itself. The hanger means must be such that it can be installed by a single individual worker generally while standing on the floor of the cargo container. Additionally, the strap portion which hangs down from the gripping means must be substantially coextensive with the wall. This problem manifests itself in the fact that the deck or support bars are of a fixed length and once inserted in a strap portion on one wall, will extend across the cargo area to mate with the strap portion on the other wall. Thus, if the strap portions, by their design or construction, tend to extend or curve away from the wall, they will tend to define a distance therebetween which may be several inches less than the length of the bar. Thus, the installer must force them into a position whereby they are coextensive with the wall in order to effect engagement. As is apparent, engagement will be difficult but disengagement will be even more difficult since the installer will not only have to effect disengagement but work against the spring action of the two strap portions.

It is, therefore, a principle object of this invention to provide a simple, durable and relatively inexpensive hanger which allows quick attachment and removal. Another object of this invention is to provide a hanger which will increase its holding action on the top rail as the weight is increased thereon. But another object of this invention is to provide a hanger which, by its construction, will remain coextensive with the adjacent wall whether in the loaded or unloaded state. Still another object of this invention is to provide a hanger which transfers the forces being exerted thereon not only to the top rail but to the side walls of the cargo container as well.

SUMMARY OF THE INVENTION

The vertically suspended hanger means of the invention cooperate with the upper rail and the wall of an intermodal container to provide a support point for a horizontally extending bar. In practice, a series of the vertically suspended hanger means are positioned along the two main walls of the intermodal container at some desired spacing and then the support bars extend therebetween. The deck is then laid on the support bars to divide up the normally open cargo area. Since all the vertically suspended hanger means are identical in construction, reference will be made to one, specifically with the understanding that it will refer to all such hanger means referred to hereafter.

The vertically suspended hanger includes a hook end or gripping means which has one portion that grasps the top of the rail and first and second wall contacting portions. Pivotally suspended from the hook means is a link means which includes a portion for frictionally engaging the the bottom side of the top rail at a point directly opposite from where the upper hook end engages it. That is, the hook and link grip the top rail in a pliers-like fashion on opposite sides, such that the rail is compressed rather than bent. A hanger strap is pivotally connected to the link and extends downwardly therefrom. The body portion of the hanger strap includes slots or whatever that cooperate with the support bars that in turn carry the deck. Most importantly, the body portion in use will be generally coextensive with the wall of the cargo container. In operation, once the hook end means is positioned over the top of the top rail and snugly against the side wall, the link and hanger strap are allowed to hang freely. Due to the location of the respective first and second pivot means, the gripping portions of the link means contact the bottom of the top rail while allowing the hanger strap to extend generally freely down therefrom coextensively with the wall of the cargo container. With this relationship of elements and pivot points, the weight of the load is transferred both to the top rail as well as the wall of the cargo container. The weight of the load in fact is utilized to activate the clamping action on the top rail and as the load increases so does the gripping action on the top rail. Most importantly, the hanger strap, regardless of the load thereon, will be urged in a direction to maintain it coextensive with the wall of the cargo container and the load will be transferred, in some relationship, partially to the top rail and partially to the wall of the cargo container.

Other features of the invention will be ascertained from the following description.

DETAILED DESCRIPTION OF THE SHOWN EMBODIMENT

Figure 1:
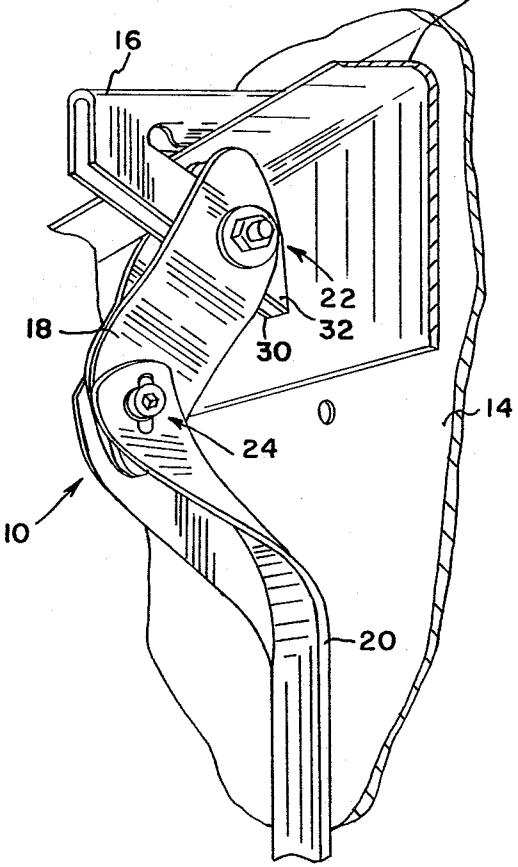
FIG. 1 is a perspective view of the upper portion of the vertically suspended hanger means gripping the top rail.

Referring particularly to the drawings and more particularly to FIG. 1, there is shown the vertically extended hanger means 10. As displayed, the hanger means 10 is supported on the top rail means 12 which is an integral part of the intermodal cargo container means 14, and normally extends on both sides of the length thereof. The particular connection or method of incorporation of the top rail means 12 with the container means 14 is not particularly important as long as there is secure relationship therebetween and they are close enough to allow the vertically extended hanger means 10 to assume a generally coextensive relationship with the wall. The vertically extended hanger means 10 includes a hook end means 16, a link means 18 and a hanger strap means 20, the various elements being connected via first and second pivot means 22 and 24.

Figure 4:
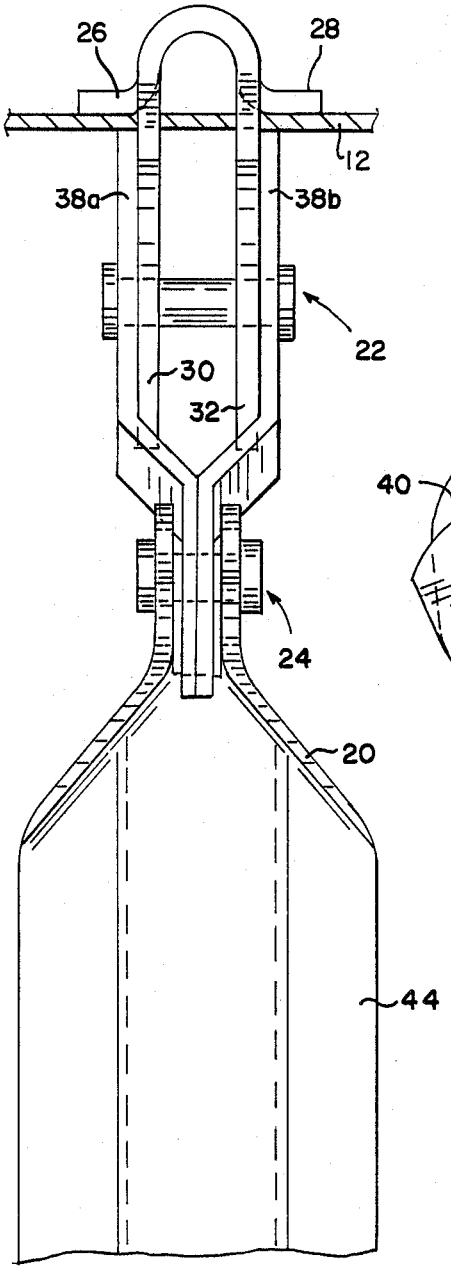
FIG. 4 is a front view of FIG. 3 looking from the left to right thereof.
Figure 3:
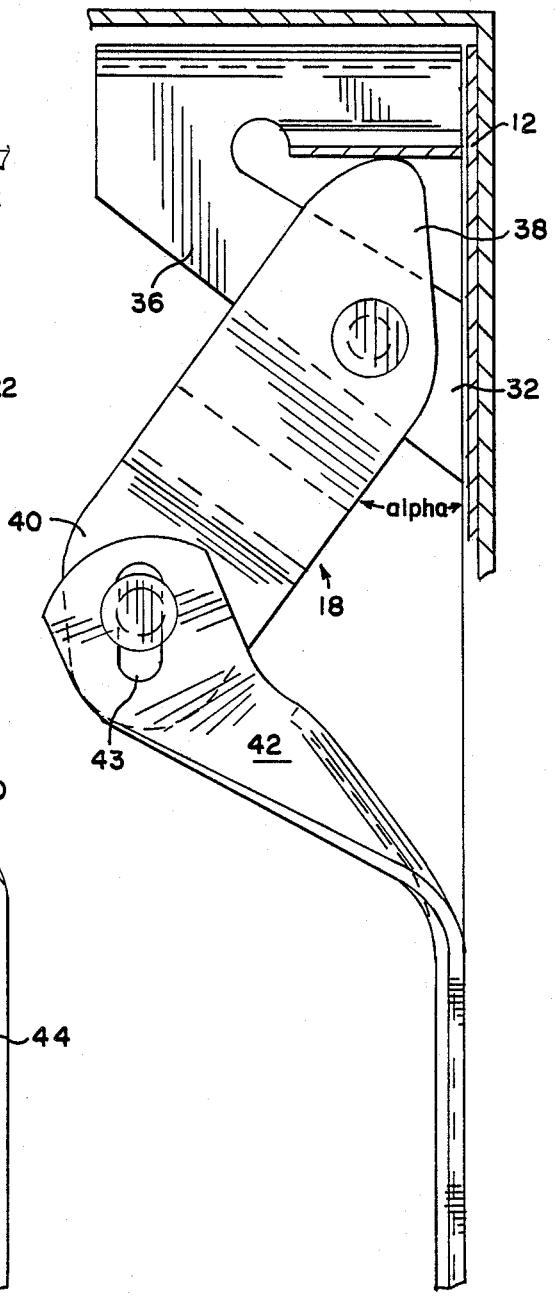
FIG. 3 is a partial side view of the vertically extended hanger means.

The hook end means 16, as shown in both FIGS. 1 and 4, is of a generally U-shaped profile and includes a first and second upper rail contacting means or tab means 26 and 28; first and second wall contacting means 30 and 32 (as shown in FIGS. 3 and 4), the over-all configuration thereof being somewhat hook-shaped. In practice, the hook end means 16 fits over the top rail 12 while said first and second tab means 26 and 28 engage the top surface of the rail at two spaced apart points at the same time the first and second wall contacting means 30 and 32 contact the vertical wall portion of the cargo container.

Pivotally secured to lower leg portion 36 of hook end means 16 is link means 18. The link means 18 includes a lower rail contacting means 38 which in a preferred embodiment are the two legs **38*a* and 38*b* of a Y-shaped clevis. As is apparent from a consideration of FIG. 4, the particular design of the lower rail contacting portion 38 is not critical other than the fact that the two arms of the clevis 38*a* and 38*b* engage the top rail means 12 generally on the side opposite that engaged by the first and second tab means 26 and 28** at two spaced apart points whereby the top rail means is subject to a majority of compression forces and a minimum of bending.

The hanger strap means 20 is pivotally secured to the base of the Y-shaped clevis 40 via pivot means 24. Included within the hanger strap means 20 is an end means 42 which in the preferred embodiment is a right angle twist portion that constitutes the transition from the slightly bowed depending strap portion 44 to the pivot portion 24. The generally flat strap portion 44 extends downwardly generally coextensive with the wall 14 of the cargo container. As is apparent from Figure 2, in this embodiment, slot means 46 are provided in the surface thereof. It is apparent any type of interface means is suitable as long as it matches the corresponding interface means on the support bar 48.

A variation of second pivot means 24 is shown in FIG. 3 in that a lost motion slot means 43 is provided between link means 18 and hanger strap means 20. In practice, should the link 18 and the hook end means 16 jam against the rail means 12, the freedom provided in the lost motion slot means 43 can be employed to jar them loose.

Figure 2:
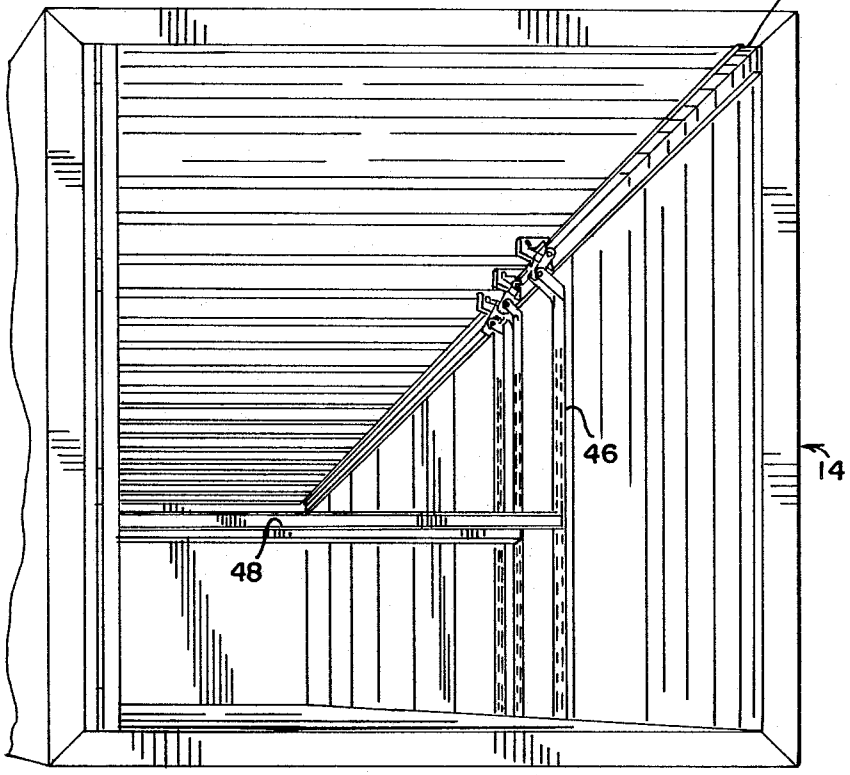
FIG. 2 is a perspective view illustrating my invention showing the relationship thereof to the inside cargo area of an intermodal container with two support bars in place.

From a consideration of FIGS. 1, 2 and 3, it will be noted that the pliers-like gripping is a camming relationship between the hook end means 16 and the link means 18. The greater the weight placed upon the hanger strap means 20 the greater cam action, that is, you will ride farther up on the camming surface. Additionally, because of the relationships of the pivot points and the camming surface, not all the force of the load will be transferred to the top rail means 20. The camming acton of the linked means 18 and hook end means 16 will force the second wall contacting means 32 against the cargo container wall. As previously mentioned, another distinct advantage of this invention is that because of the cooperation of the first and second pivot point means 22 and 24, the hanger strap means 20 is continuously urged at the very least by the forces of gravity to lay flat against with the wall means 14. There have been prior art devices which because of their attachment to the top rail tend to angle the hanger strap out into the cargo area. This is necessitated by the fact that the pivoting of the hanger strap against the side wall is the means whereby the vertically suspended hanger means is secured to the top rail. Thus the installer of the temporary deck will insert one end of the support bar into engagement with the hanger strap on the one side of the cargo area and then be forced to overcome the spring action or lever action of the two hanger straps before he can achieve engagement. Stated another way, the support bar is almost the same length as the width of the cargo container and thus the hanger straps must be coextensive with the walls before complete engagement at both sides can be effected. The various elements of the vertically extended hanger means 10 hereunder consideration have various relationships between their major planes. In this preferred embodiment, the link means 18 has a major axis which forms an accute angle alpha with the major plane of the wall means 14.

As is described, it is apparent that the vertically suspended hanger means 10 hereunder consideration provides a substantial amount of forgiveness for tolerance variations in the top rail means, as well as for over-all tolerance stack ups for the device itself. Simply, in the initial unloaded state, for hanger means on the high side of the tolerance variations and/or thicker top rail means, the angle between the major axis of the link means 18 and the major axis of the wall means 14 will be greater. On the other hand, in situations on the low side of the tolerance stack-up and/or thinner top rail means, the same angle will be on the smaller than optimum size. However, in either situation the vertically suspended hanger means, is self compensating and will adjust to such variations to provide a reliable, secure gripping action under load, maintaining the hanger strap coextensive with the wall of the cargo container while proportioning the load between the top rail means and the wall of the cargo container.

Having thus described the invention in detail and with sufficient particularlity as to enable those skilled in the art to practice it, what is desired to have protected by Letters Patent is set forth in the following claims.

The embodiments of the invention in which an exclusive property or privilege is claimed are defined as follows.

What is claimed is:

1. A vertically suspended hanger means which provides for placement of at least one temporary deck in the normally open cargo area of an intermodal container means that includes wall and top rail means, comprising:

a hook end means which fits over and engages the top rail means;

a link means pivotally secured to said hook end means whereby said link means releaseably engages said top rail means at a point opposite that engaged by said hook end means; and hanger strap means pivotally secured to said link means and extending downwardly coextensively with the surface of said wall means of said intermodal container means, such that as load is placed upon said hanger strap means, the gripping force of said hook end means and said link means on said top rail means increases.

2. The vertically suspended hanger means of claim 1 wherein said hook end means includes a top rail engagement portion means having a generally "U"-shaped profile with first and second tab means extending out therefrom; and said link means is a generally "Y"-shaped clevis means having upper spaced apart first and second arm means contacting said top rail means and a base means pivotally carrying said hanger strap means.

3. The vertically suspended hanger means of claim 2 which includes a lost motion means.

4. The vertically suspended hanger means of claim 3 wherein:

said first and second tab means of said top rail engagement portion means grip the top rail at two spaced apart points; and said first and second arm means of said Y-shaped clevis means grip the top rail at two spaced apart points.

5. A vertically suspended hanger means, a series of which cooperates with the top rail means and wall means of an intermodal container means whereby providing support for the placement of at least one temporary deck means in the normally open cargo area, a single multi-deck hanger means comprising:

a hook end means having first and second upper rail contacting means and having first and second wall contacting means;

a link means having a lower rail contacting means;

a first pivot means pivotably securing said link means to said hook end means whereby said lower rail contacting means and said first and second upper rail contacting means exert gripping force on said top rail means;

a hanger strap means, including, an end means and a body portion means which includes means for interface with said temporary deck means; and a second pivot means pivotably securing said link means to the end means of said hanger strap means whereby said body portion means extends downwardly generally coextensively with said wall.

6. The multi-deck hanger means of claim 5 which includes a lost motion means.

7. The multi-deck hanger means of claim 5 wherein said first and second upper rail contacting means of said hook end means and said lower rail contacting means of said link means are located on opposite sides of said to rail whereby said top rail is subject to at least two separate areas of compressions in response to vertical load on said hanger strap means.

8. The multi-deck hanger means of claim 7 wherein said link means has a major axis and said wall means has a major axis, and the angle means formed between said two major axis means is acute.

9. The multi-deck hanger means of claim 8 wherein said end means of said hanger strap means includes an off-set section means.

10. The vertically suspended hanger means of claim 9 wherein said second pivot means includes an elongated slot means.

* * * * *